US008707831B2

(12) United States Patent
Palmer

(10) Patent No.: US 8,707,831 B2
(45) Date of Patent: Apr. 29, 2014

(54) DUAL-DRIVE, SELF-RATCHETING MECHANISM

(76) Inventor: Leon R. Palmer, Somerset, MA (US)

( * ) Notice: Subject to any disclaimer, the term of this patent is extended or adjusted under 35 U.S.C. 154(b) by 394 days.

(21) Appl. No.: 12/925,542

(22) Filed: Oct. 25, 2010

(65) Prior Publication Data

US 2012/0096991 A1 Apr. 26, 2012

(51) Int. Cl.
*B25B 13/46* (2006.01)

(52) U.S. Cl.
USPC ..... 81/57.29; 81/60; 74/810.1

(58) Field of Classification Search
USPC ..... 81/57.29, 60, 54–57.37, 430–435
See application file for complete search history.

(56) References Cited

U.S. PATENT DOCUMENTS

| | | | | | |
|---|---|---|---|---|---|
| 269,264 | A | * | 12/1882 | Cloyd | 74/417 |
| 1,341,700 | A | * | 6/1920 | Alexander | 81/57.29 |
| 1,635,882 | A | * | 7/1927 | Barbour | 81/30 |
| 1,911,355 | A | * | 5/1933 | Dorman | 81/30 |
| 1,912,011 | A | * | 5/1933 | Riess et al. | 192/150 |
| 2,348,266 | A | * | 5/1944 | Selby | 74/417 |
| 2,703,030 | A | * | 3/1955 | Marvin | 81/57.29 |
| 3,232,149 | A | * | 2/1966 | Duchesne | 81/57.31 |
| 3,696,694 | A | * | 10/1972 | Boro | 81/57.27 |
| 4,126,096 | A | * | 11/1978 | Arnaud Malavard | 108/145 |
| 4,296,654 | A | * | 10/1981 | Mercer | 81/57.26 |
| 4,474,089 | A | * | 10/1984 | Scott | 81/57.29 |
| 4,520,692 | A | * | 6/1985 | Cummins | 475/245 |
| 4,770,071 | A | * | 9/1988 | Steier | 81/63 |
| 5,058,463 | A | * | 10/1991 | Wannop | 81/57.29 |
| 5,784,934 | A | * | 7/1998 | Izumisawa | 81/57.26 |
| 5,931,062 | A | * | 8/1999 | Marcovici | 81/57.31 |
| 6,112,621 | A | * | 9/2000 | Ochiai | 81/57.29 |

FOREIGN PATENT DOCUMENTS

| | | | | | |
|---|---|---|---|---|---|
| JP | 03221379 | A | * | 9/1991 | B25B 21/00 |

* cited by examiner

*Primary Examiner* — Lee D Wilson
*Assistant Examiner* — Melanie Alexander

(57) ABSTRACT

A dual-drive self-ratcheting device, that efficiently converts alternating clockwise and counterclockwise rotation applied to its input, into unidirectional rotation at its output, by employing a plurality of means, such as, but, not limited to, ratchet and pawls or roller-type clutch mechanisms, oriented the same and arranged in tandem, on a common drive shaft and caused to alternately drive the shaft continuously in either all clockwise or counterclockwise direction, as oscillatory motion is applied to its input;

while the first ratchet and pawl or roller clutch mechanism is caused to impart motion onto a drive-shaft, the second ratchet and pawl or roller clutch mechanism is simultaneously caused to override the driveshaft;

while the second ratchet and pawl or roller clutch mechanism is caused to impart motion onto a drive-shaft, the first ratchet and pawl or roller clutch mechanism is simultaneously caused to override the driveshaft; hence regardless of the direction of rotation applied to the input, the output is either always clockwise or counterclockwise; dual-drive eliminates the need for unproductive ratcheting-up between drives.

7 Claims, 24 Drawing Sheets

DUAL-DRIVE, SELF-RATCHETING MECHANISM

FIELD OF THE INVENTION

This invention relates to mechanical drive systems and more particularly to those in which the output rotation can be solely clockwise, regardless of the direction of the input rotation and the output rotation can be solely counterclockwise, regardless of the direction of the input rotation. The direction of output rotation, from an oscillatory input, is selective within the same embodiment.

BACKGROUND OF THE INVENTION

This invention, a self-ratcheting mechanism, has numerous applications in consumer, medical and industrial products, but, a screwdriver is the preferred item to serve as the exemplification of the advantages, that the self-ratcheting mechanism provides. Prior art ratcheting screwdrivers, employ a single ratcheting mechanism, that is required to be intermittently-ratcheted between drives and therefore only ready-to-drive hardware 50% of the time, while the remaining 50%, is time and effort that is unproductively spent, ratcheting-up. Thus, screwdrivers, mechanized with the conventional single-ratcheting mechanism, are only 50% efficient.

Whereas, a screwdriver, mechanized with the self-ratcheting system, employs a pair of conventional ratcheting or clutching mechanisms to eliminate the users need to waste time and effort ratcheting between drives. The ratcheting occurs automatically within the mechanism, as reciprocating input-motion is applied while the screwdriver is being operated.

Because the dual-drive self-ratcheting mechanism comprises a minimum of a pair of any ratchet and pawl arrangement or clutching means, solely for exemplification and simplicity, the included illustrations depict a suggested assembly procedure of a dual-drive self-ratcheting mechanism, that employs a pair of the standard ratchet wheel and pawl arrangement, with a 3-position switch for selecting forward drive, reverse drive and standard [non-ratcheting] direct-drive.

BRIEF SUMMARY OF THE INVENTION

The invention is a mechanism, that converts oscillatory motion applied to its input, into unidirectional axial rotation at its output. The mechanism can be set to produce solely clockwise rotation at its output regardless of the direction of rotation of the input and can be set to produce solely counterclockwise rotation at its output regardless of the direction of rotation of the input. The mechanism must be embodied into a product in order for its advantages to be acknowledged and appreciated. Even though the mechanism has numerous applications, the frequently-used manually-operated ratchet screwdriver is selected, not as the invention, but, as the exemplification of an ideal application.

One objective of this exemplification, is to create a manually-operated, screwdriver hand tool, that ratchets-up automatically during use, thereby eliminating the users need to perform the unproductive ratcheting-up motion between each productive drive.

Another objective, is to create a manually-operated, self-ratcheting screwdriver hand tool, that is operated single-handedly, thereby enabling fastening hardware, to be held in place with opposite hand.

Another objective is to provide a manually-operated self-ratcheting screwdriver hand tool, whereby resistance-to-backwards-rotation, from the screw during its installation into a material, to enable ratcheting-up, is no longer necessary.

Another objective is to provide a manually-operated, self-ratcheting screwdriver hand tool, with a mechanical means to simultaneously switch the plurality of ratcheting mechanisms, from clockwise rotational output, to counterclockwise rotational output, and from counterclockwise rotational output to clockwise rotational output, to eliminate the switching of each ratchet mechanism separately. FIG. 6, 7, 8, 9.

Another objective is to create a manually-operated, self-ratcheting screwdriver, whereby the self-ratcheting mechanism is operated via the axial turning of a pistol-grip-angled handle, in clockwise and counterclockwise direction, as well as swung radially, for added leverage for applying finishing-torque and breaking the finishing to torque loosen fastening hardware. FIG. 10, 11, 12, 13

Another objective is to create a manually-operated, self-ratcheting screwdriver hand tool, whereby its pistol-grip handle can be pivoted down further to perpendicular to the screwdriver body, thereby increasing torque capacity for tightening or loosening hardware. FIG. 14

Another objective is to create a manually-operated, self-ratcheting screwdriver hand tool, whereby its handle can be pivoted 360 degrees radially, relative to the screwdriver body, thereby enabling left-handed and right-handed operation, to drive hardware at a plurality of angles FIG. 15, FIG. 16

Another objective is to create a manually-operated, self-ratcheting screwdriver hand tool, whereby its handle can be radially pivoted to and retained in a plurality of desired angles, FIG. 5A, depending on the task and situation, such as limited space in which to maneuver the tool and difficult-to-access hardware.

Another objective is to create a manually-operated, self-ratcheting screwdriver hand tool, whereby, resistance-to-rotation from the hardware, is not required, in order for the ratcheting mechanism to ratchet-up.

BRIEF DESCRIPTION OF THE DRAWINGS

FIG. 9B Top view of switches locked into back-most position

FIG. 9C Top view of switches disengaged from center-knob

DETAILED DESCRIPTION OF THE DRAWINGS

The preferred order-of-assembly of components of a self-ratcheting mechanism, that employs a pair of the standard ratchet and pawl arrangement is described below.

Figure 1:
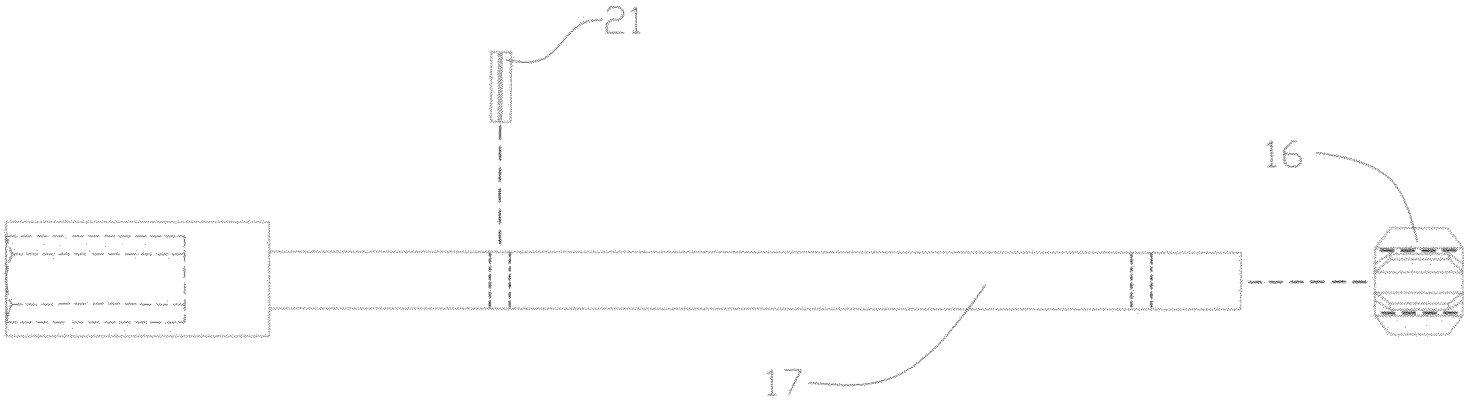
FIG. 1 Exploded view of drive shaft, first ratchet wheel and retaining pin.

FIG. 1: Toothed Ratchet Wheel 16, prior to being slid onto and secured to Driveshaft 17, with Spring-Pin 21.

Figure 2:
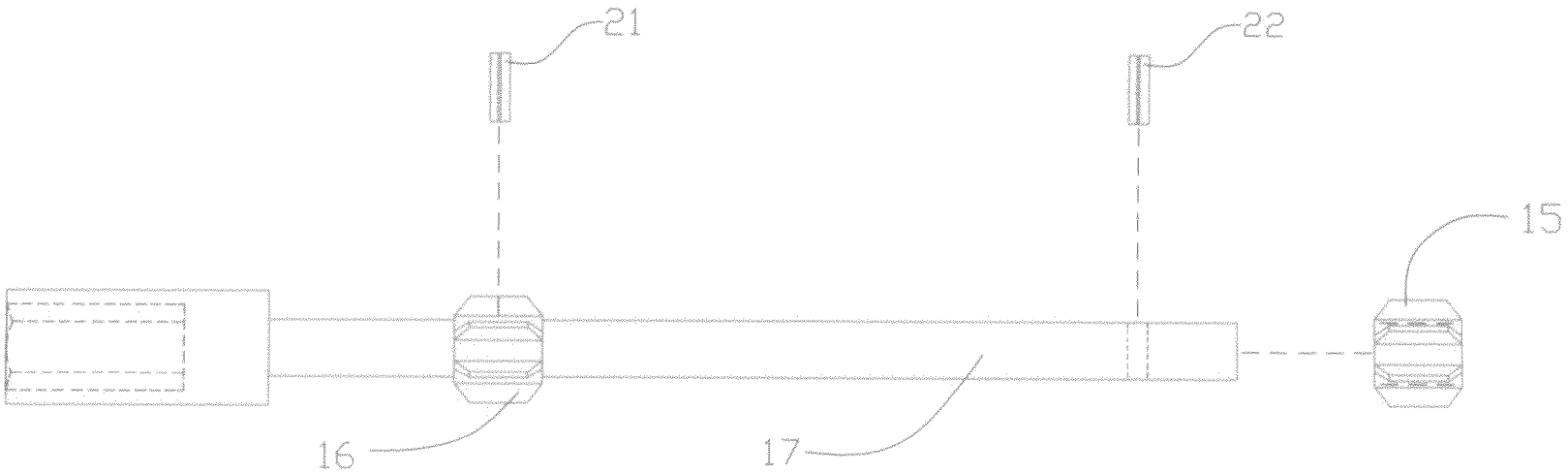
FIG. 2 Exploded view of drive shaft, second ratchet wheel and retaining pin.

FIG. 2: Toothed Ratchet Wheel 16 is slid onto Driveshaft 17. The thru-hole, that runs perpendicularly through the axis of Toothed Ratchet Wheel 16, is aligned with the thru-hole that runs perpendicular to the axis of Driveshaft 17. Spring-Pin 21 is pressed completely into both thru-holes to secure Toothed Ratchet Wheel 16 in place on Driveshaft 17.

Figure 3:
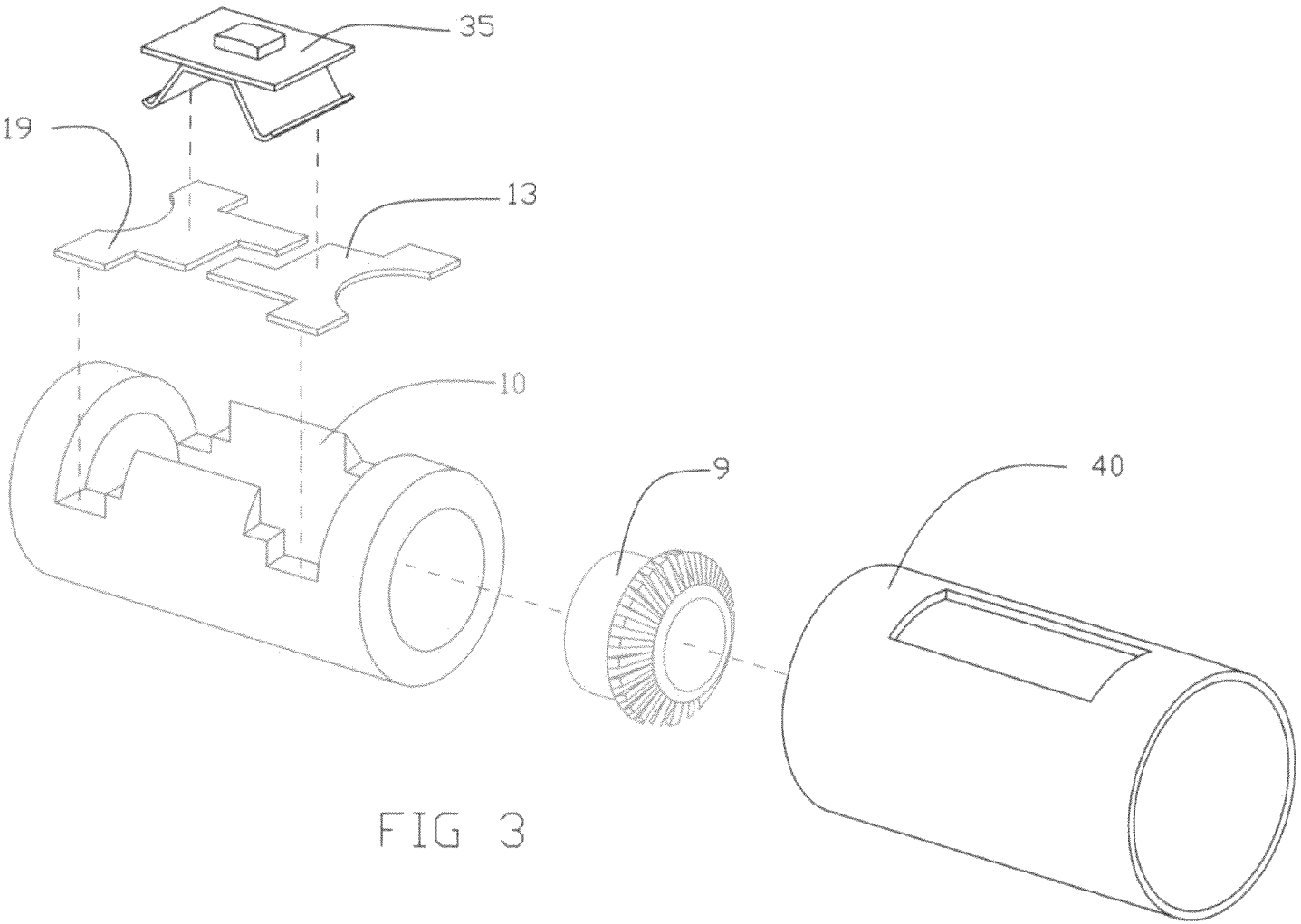
FIG. 3 Exploded view of components of first ratchet mechanism
Figure 4:
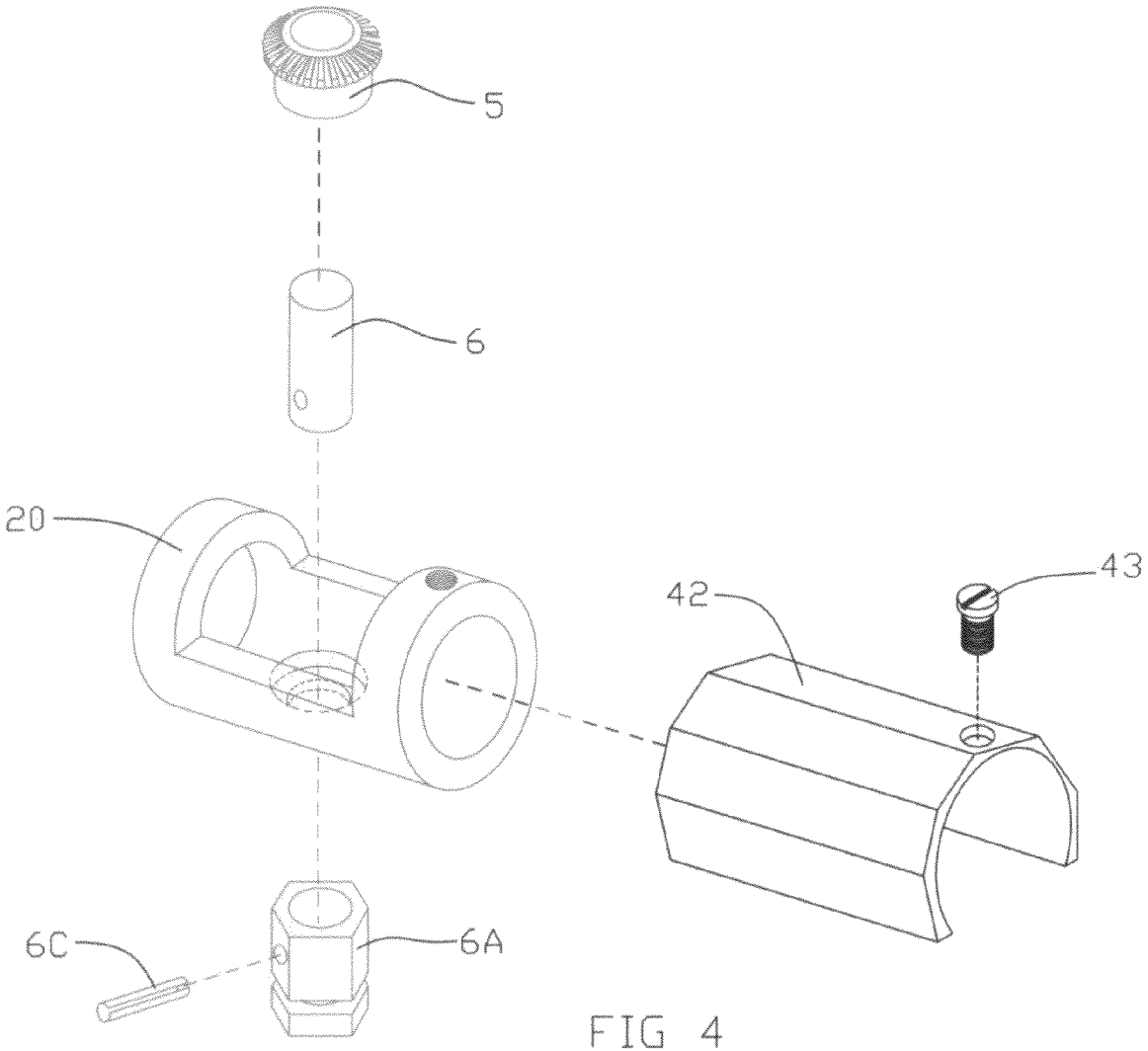
FIG. 4 Exploded view of reversing mechanism components

FIG. 3, 10: Hub of Gear 9 is pressed completely into opening provided at posterior end of hollow Ratchet Housing 10. Subassembly Ratchet Housing 10/Gear 9 is slid onto Driveshaft 17 until Housing 10 butts against Toothed Ratchet Wheel 16. Pawl 19 and Pawl 13 are placed into their respective recesses in Ratchet Housing 10 with their finger-like extensions engaging the teeth of toothed ratchet wheel 16. FIG. 3 Spring-loaded Switch 35, is placed onto Pawls 19 and 13 with its button facing up; Spring-loaded Switch 35 is compressed against Pawls 13 and 19 while Sleeve 40 is slid onto Housing 10, until button of Switch 35 projects up through slot provided in Sleeve 40. FIG. 4, 10: Axle 6 is inserted fully into center hole of Gear 5; free-end of Axle 6 is inserted into circular opening provided at the bottom recess in Gear-Train Housing 20; Housing 20 with Axle 6 and Gear 5 are slid onto Driveshaft 17 until Gear-Train Housing 20 butts against Ratchet Housing 10. Gear-Train Housing 20 is symmetrical and can be slid onto Driveshaft 17 with either end first. Cover 42 is slid onto and secured to Gear-Train Housing 20 with Threaded Fastener 43.

Figure 5:
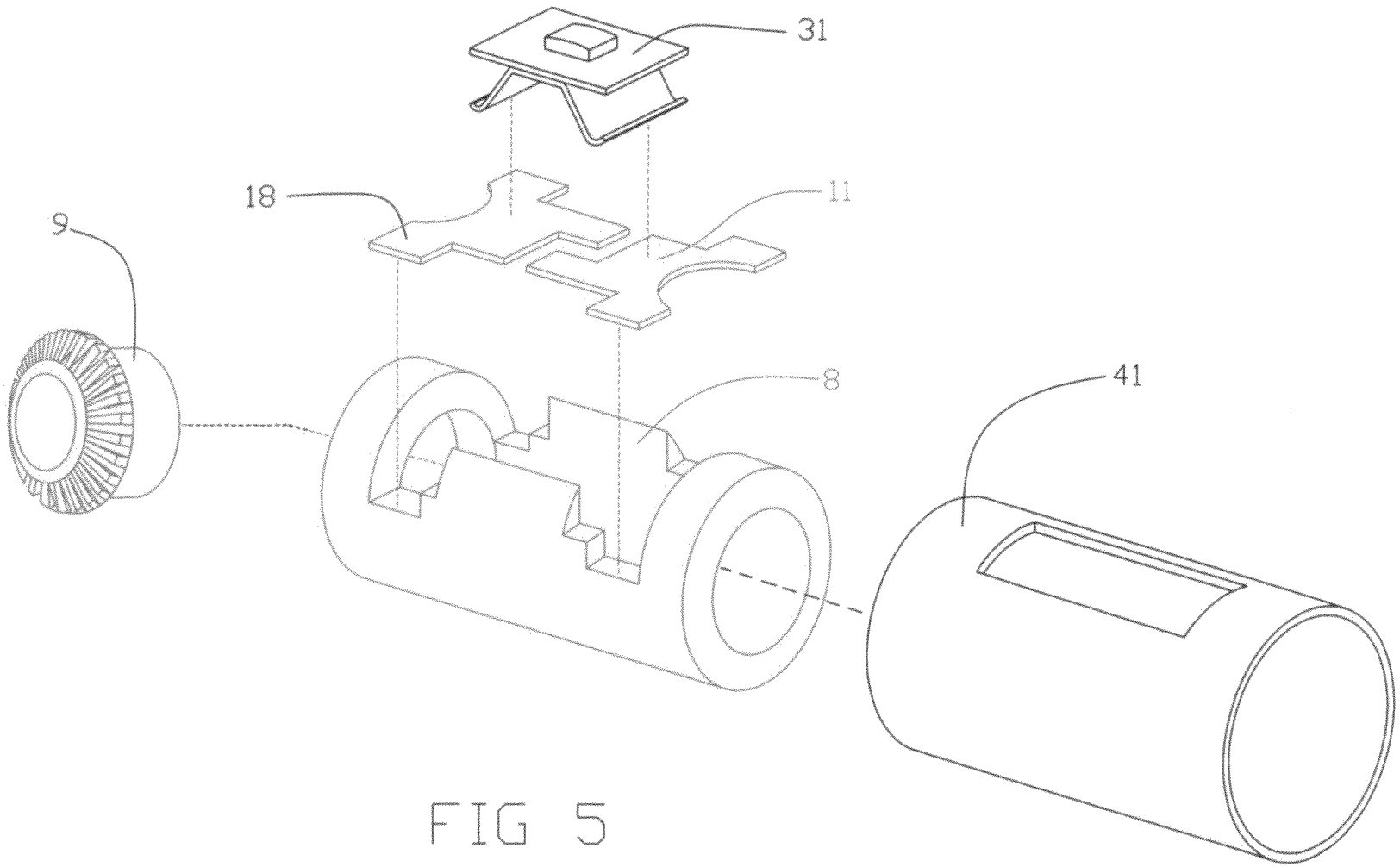
FIG. 5 Exploded view of second ratchet mechanism components

FIG. 5, 10: Hub of Gear 7 is pressed completely into opening provided at anterior end of hollow Ratchet Housing 8. Gear 7/Ratchet Housing 8 subassembly, is slid onto Driveshaft 17 until Ratchet Housing 8 butts against Gear-Train Housing 20.

FIG. 2, 10: Toothed Ratchet Wheel 15 is slid onto Driveshaft 17, through opening at posterior of Ratchet Housing 8 and is secured to Driveshaft 17 with Spring-Pin 22. The thru-hole, that runs perpendicularly through the axis of Toothed Ratchet Wheel 15, is aligned with the thru-hole that runs perpendicular to the axis of Driveshaft 17. Spring-Pin 22 is pressed completely into both thru-holes to secure Toothed Ratchet Wheel 15 in place on Driveshaft 17.

FIG. 5, 10: Pawl 18 and Pawl 11 are placed into their respective recesses in Ratchet Housing 8 with their finger-like extensions engaging the teeth of Toothed Ratchet Wheel Spring-loaded Switch 31 is placed onto Pawls 18 and 11 with its button facing up; Spring-Loaded Switch 31 is compressed against Pawls 18 and 11 while Sleeve 41 is slid onto Ratchet Housing 8 until the button of Spring-Loaded Switch 31 projects up through slot provided in Sleeve 41.

FIGS. 5A, 5B, 5C, 5D, E: Exploded view of components of Adjustable-Angle Handle 1 of screwdriver, Triangular Mounting Bracket 25 and Anti-Rotation Curved-Channel Nest 45.

Hex-shaped socket 1A is pressed into bore provided in Handle 1;

Hex-shaped extension 1B, is inserted into hex-shaped socket 1A and retained into socket, with spring-loaded ball 1BB. Pivot Pin 1E; enables 1D to be set to any of several preset angles relative to 1F. Spring-loaded lock 1C, retains any preset positions, that 1D is set to, relative to 1F. Hex-shaped center-opening of gear 2, is placed onto hex-shaped extension 3. Retaining-ring 26 is installed into circular groove provided in 3, to retain ear 2 in place on 3.

Figure 5A:
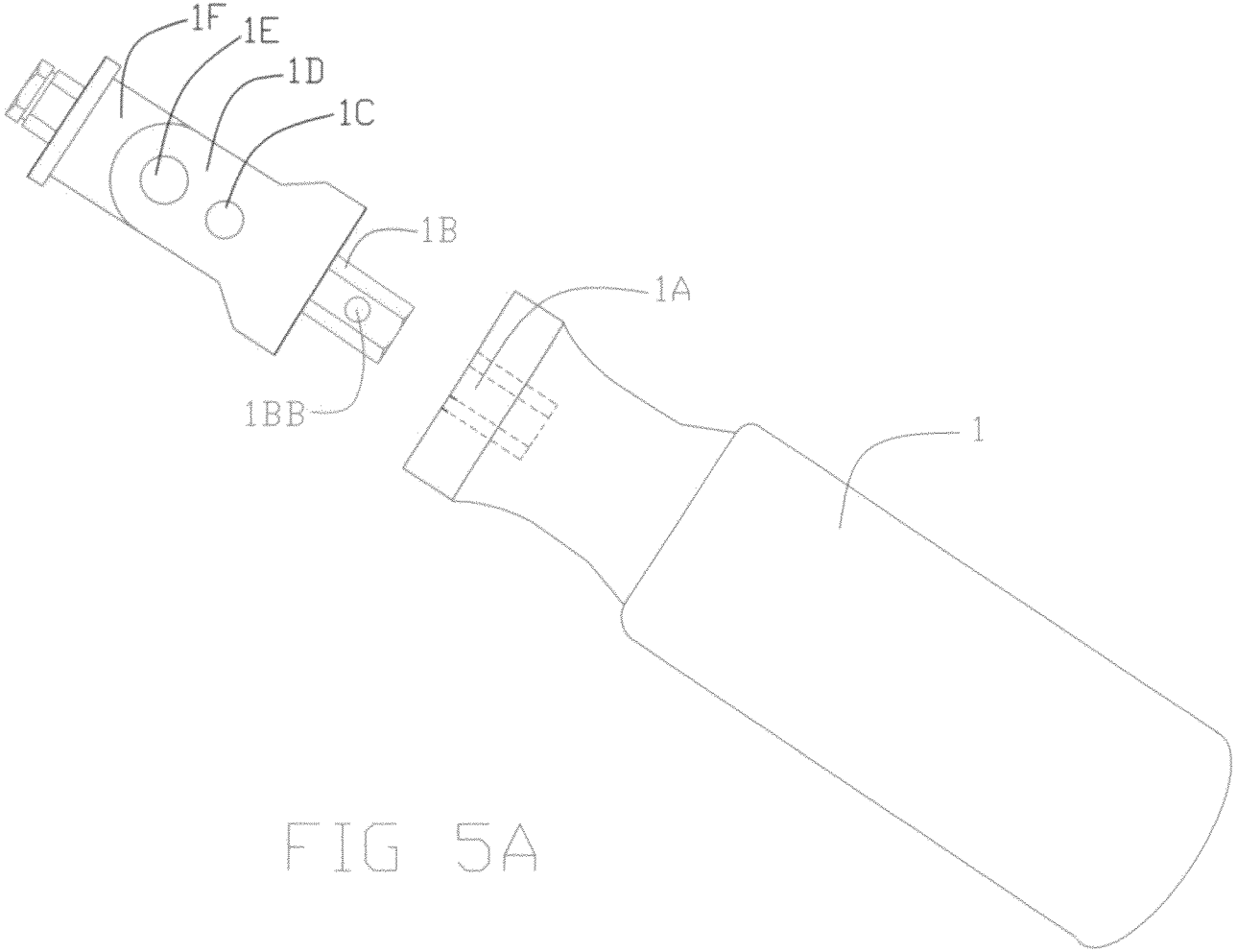
FIG. 5A Exploded view of angled handle components
Figure 5B:
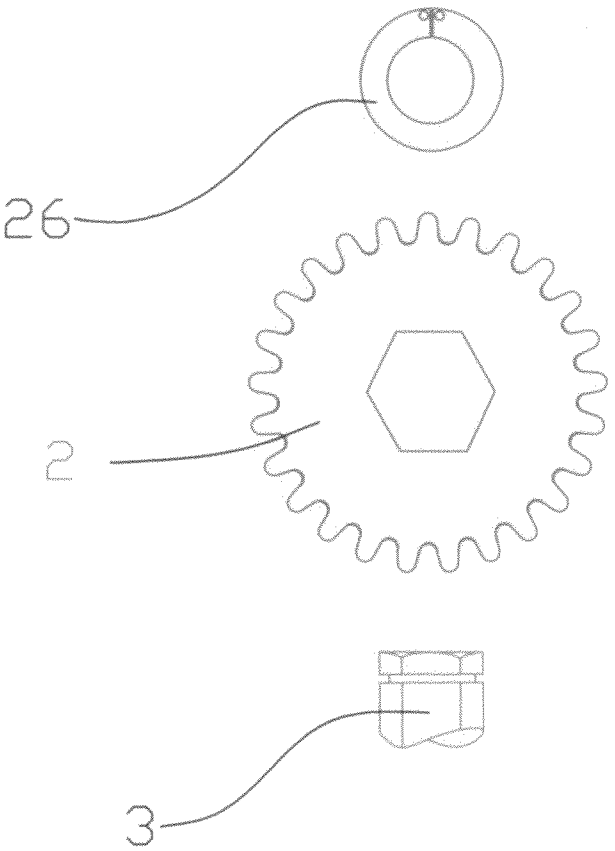
FIG. 5B Exploded view of input gear, hex axle and retaining ring.
Figure 5C:
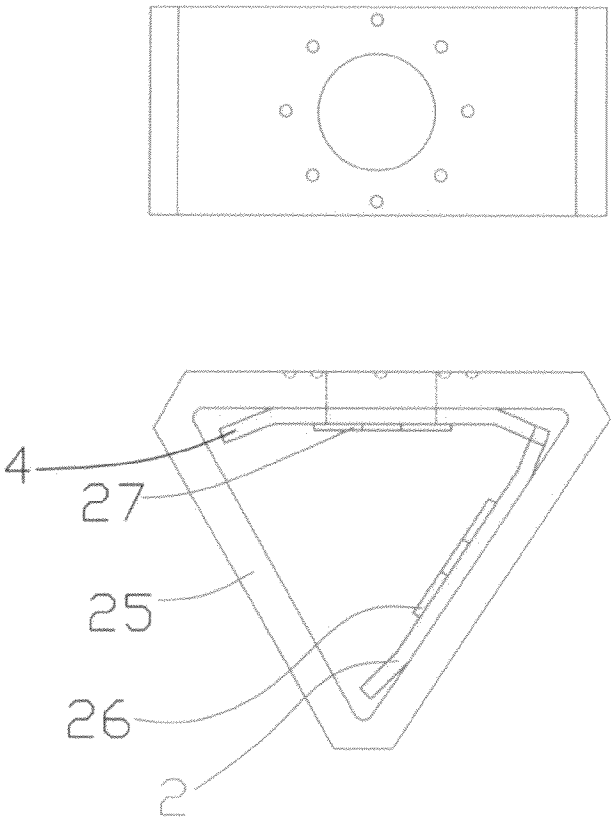
FIG. 5C Front and top view of input drive gear meshing with follower gear, housed in bracket FIG. 5D Exploded view of input driver gear, its axle and retaining ring FIG. 5E Top and side view of anti-rotation nest with spring-loaded balls FIG. 6 Side view of first and second ratchets, switched into forward-most position FIG. 7 Side view of first and second ratchets, switched into back-most position FIG. 8 Side view of first and second ratchets, switched into center position FIG. 9 View of all internal components in their respective place.
Figure 5D:
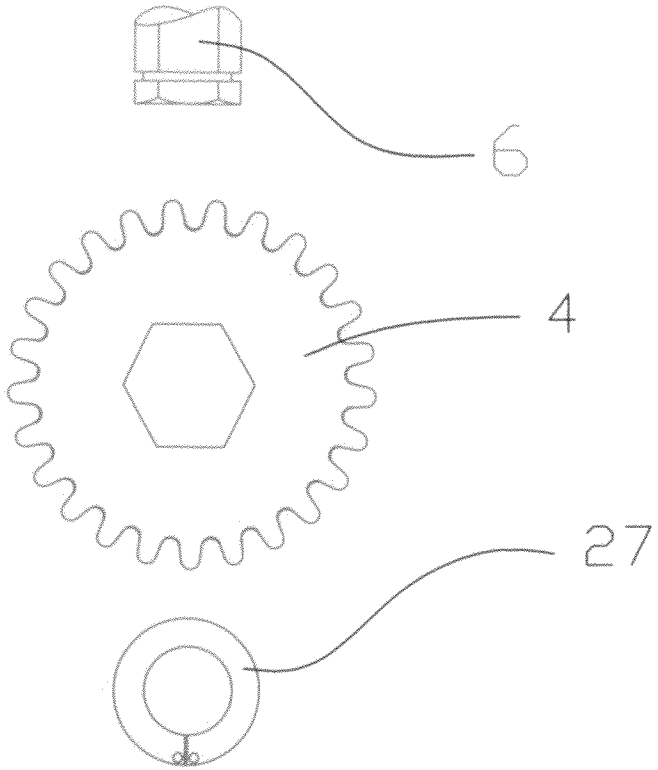
Figure 5E:
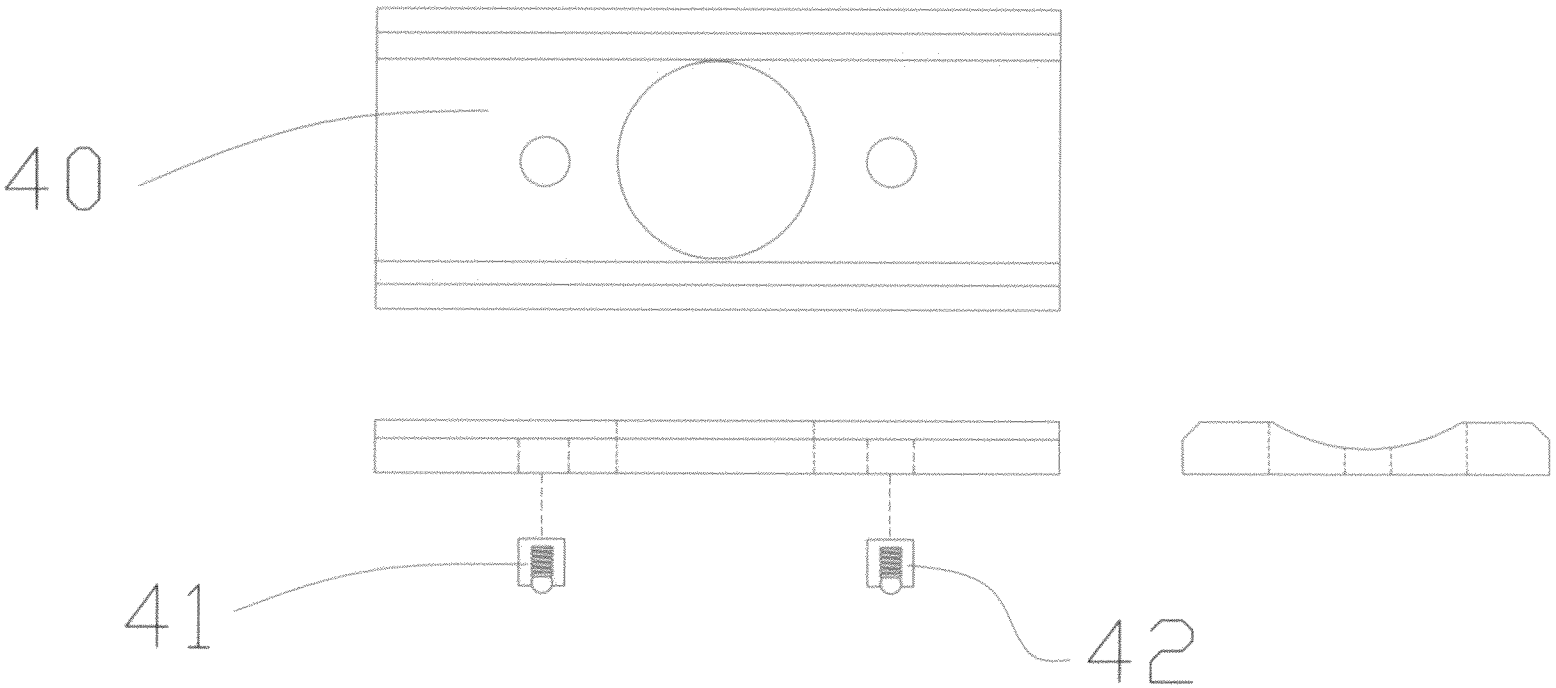
Figure 10:
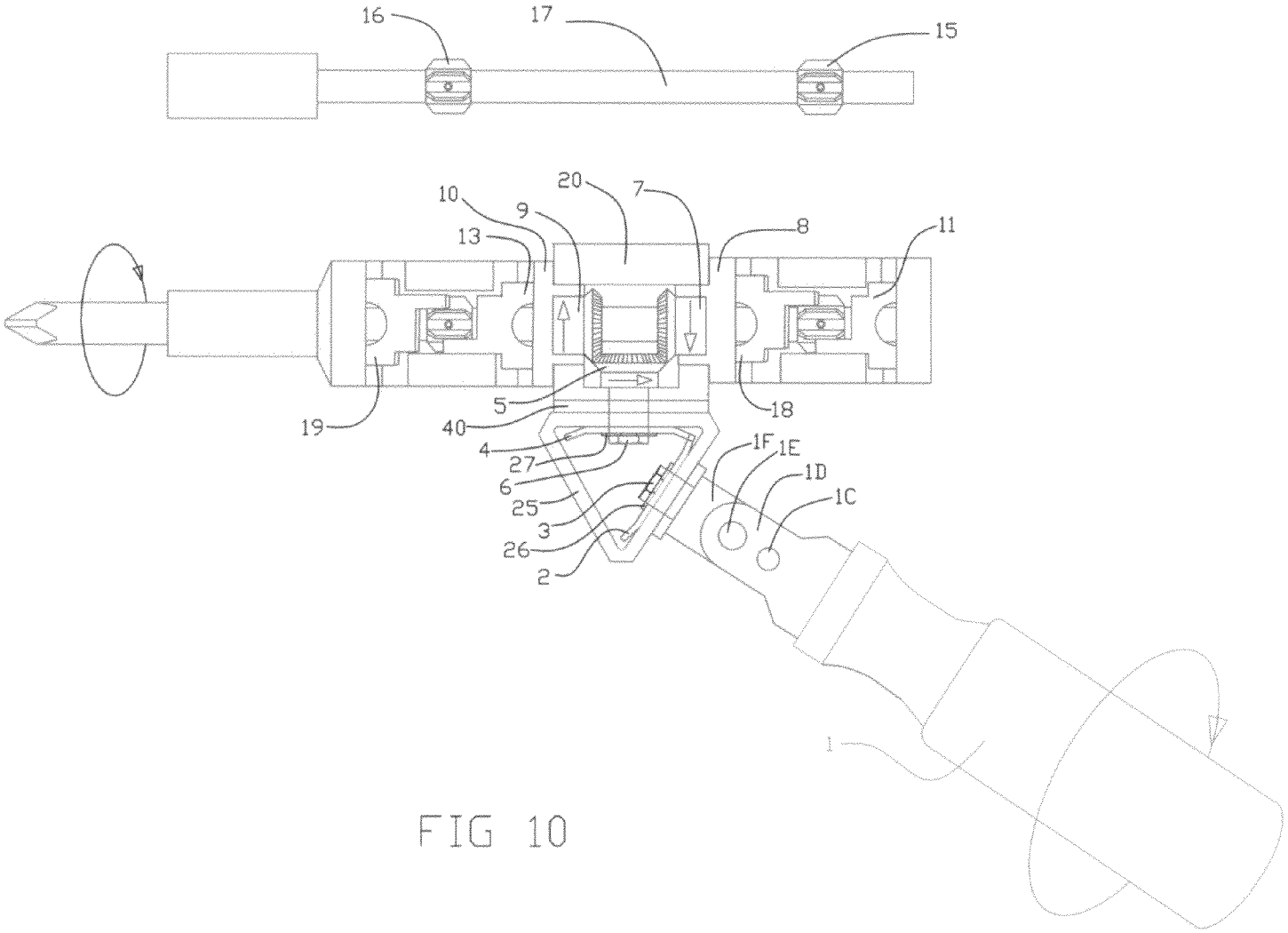
FIG. 10 View of rotational analysis of internal components. With switches in clockwise output mode, clockwise rotational input, produces clockwise rotational output.

Bottom surface of cylindrical Gear Train Housing 20 rests in Anti-Rotation Curved-Channel of Nest 45, to prevent rotation of Gear Train Housing. Spring-Loaded Balls 46 and 47 are installed into bores provided on either side of opening in Gear Train Housing. Spring-Loaded Balls 46 and 47 mate with a plurality of detents to retain Handle 1 into a plurality of positions relative to the screwdriver body. FIG. 5A, FIG. 10: Triangular-Bracket 25 is butted against bottom outside surface of Gear Train Housing 20 with the hexagonal-end of Axle 6 projecting through circular opening in Triangular-Bracket 25. Gear 4, provided with a hexagonal center hole, is placed onto hexagonal end of Axle 6, and butts against surface of Triangular-Bracket 25. Retaining-Ring 27 is installed into groove provided at hexagonal end of Axle 6, to retain Gear 4 in place.

FIG. 5A, FIG. 10: Hexagonal Post 3 is pressed to half its length into bore provided in the flanged-end of Pivoting Mechanism 1C, 10, 1E, 1F. Gear 2 is placed onto Triangular Bracket 25, so hexagonal center hole of Gear 2 coincides with the hexagonal opening in Triangular-Bracket 25. Free-end of Hexagonal Post 3 is inserted through hexagonal-shaped opening in Triangular-Bracket 25 and Gear 2. Retaining-Ring 2 is installed into groove provided in Post 3 to retain Gear 2 in place.

Figure 6:
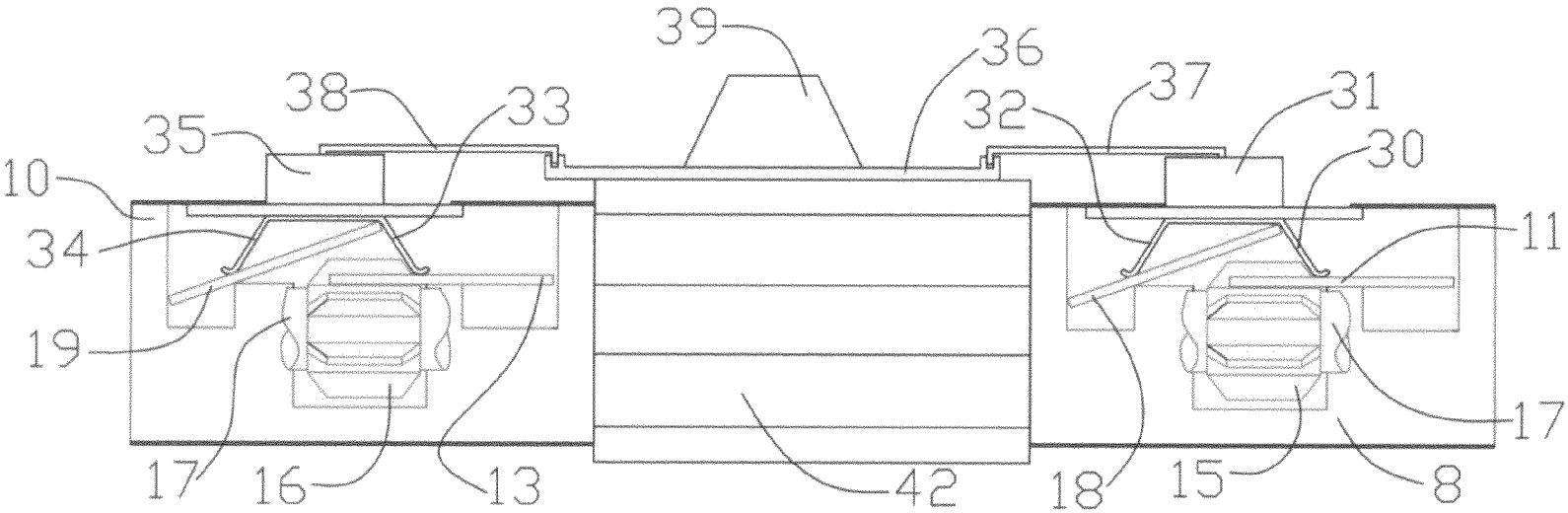

FIG. 6: Switches 31, 33 and 39 are in forward-most position, to cause CW rotation of Driveshaft 17.

Figure 7:
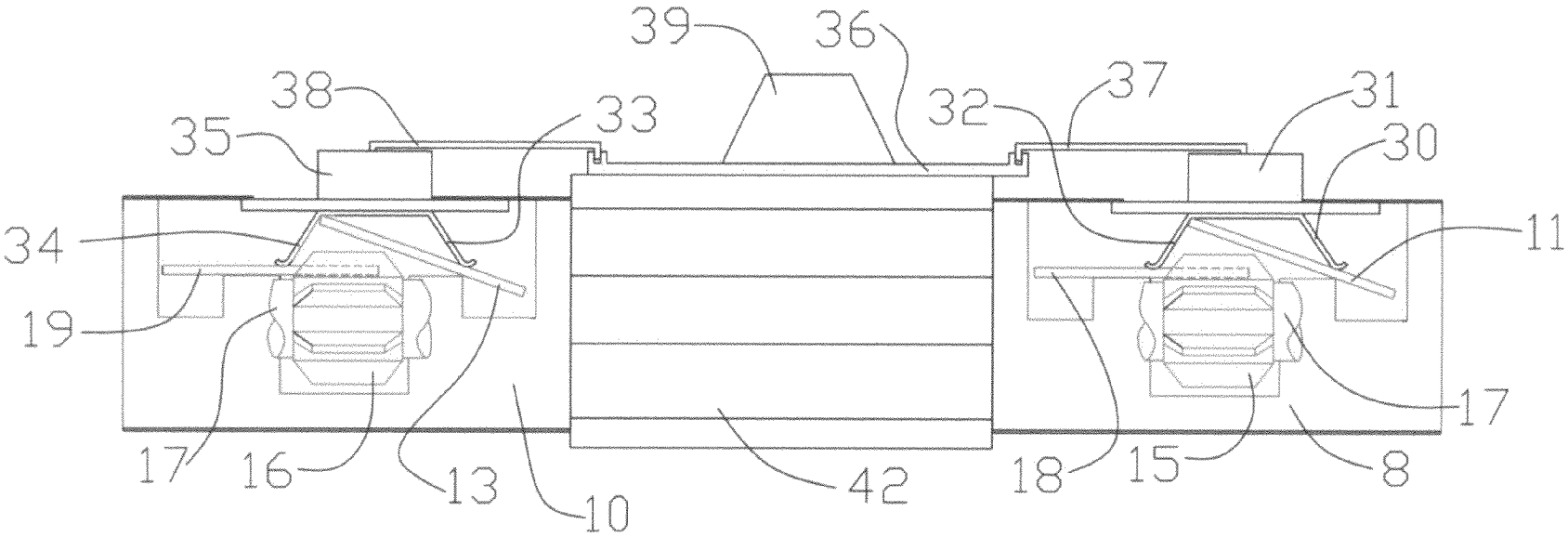

FIG. 7: Switches 31, 33 and 39, are in back-most position, to cause CCW rotation of Driveshaft 17.

Figure 8:
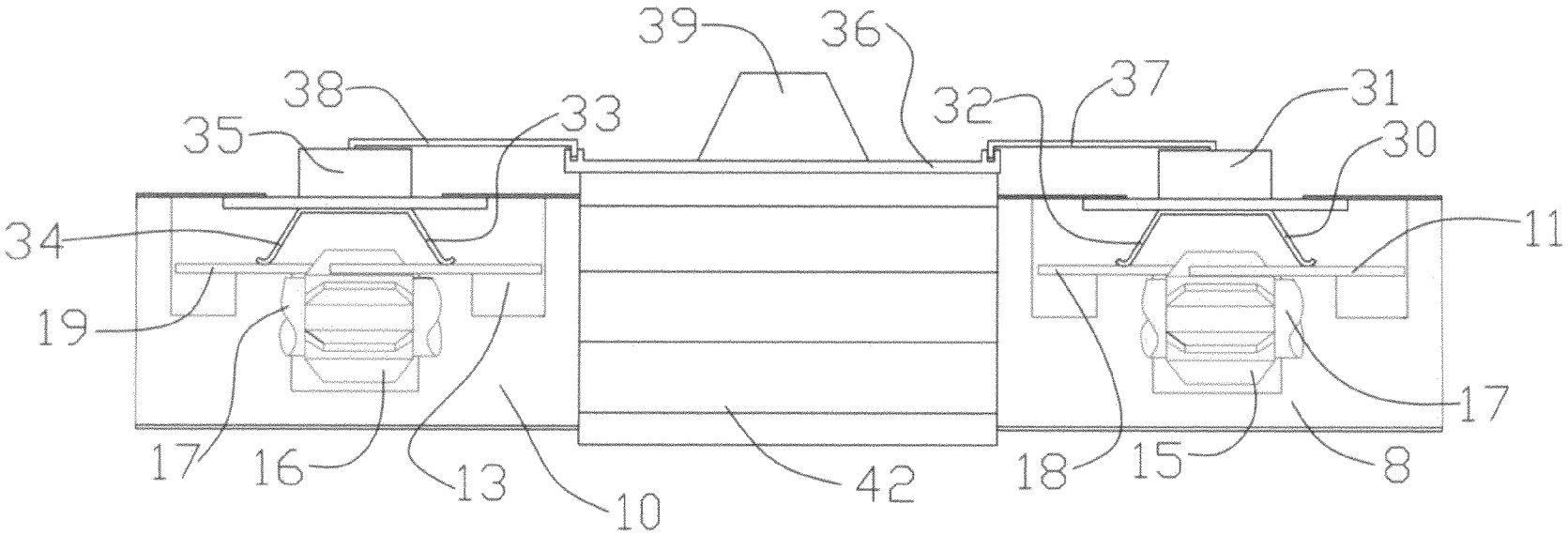

FIG. 8: Switches 31, 33 and 39 are in middle position, to cause standard direct-drive (non-ratcheting).

Figure 9:
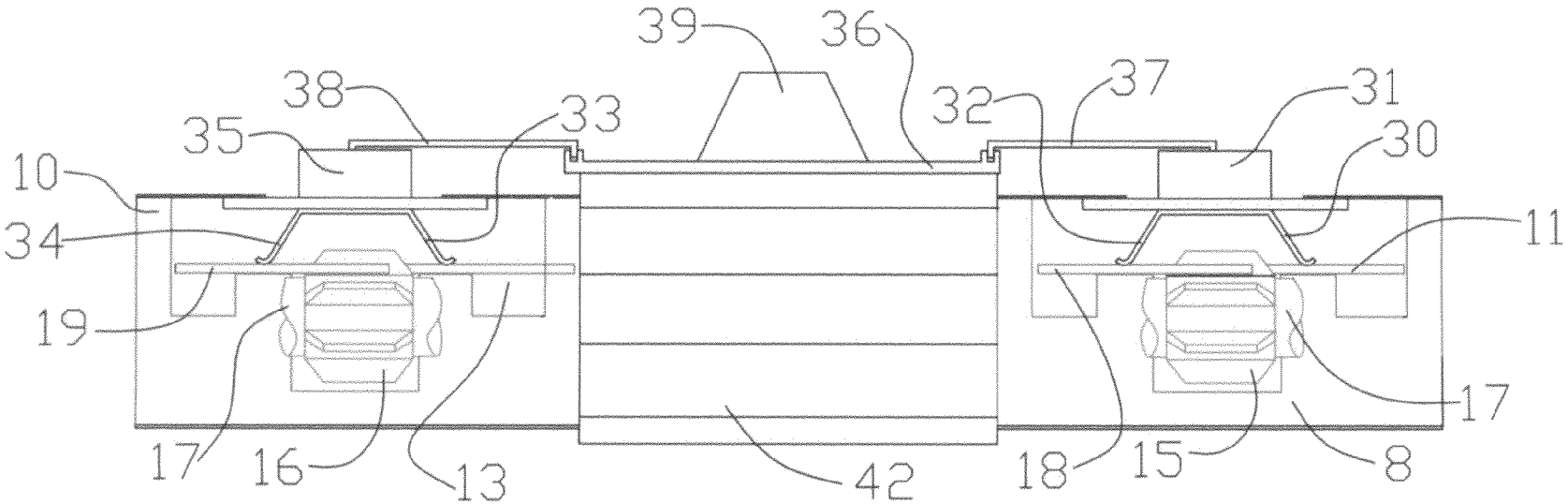

FIG. 9: Side view of the Slideable-Linkage of the switches, integrated onto screwdriver body. Switch components 30, 31, 32, 33, 34, 35, 36, 37, 38 and 39 move as a unit.

Figure 9A:
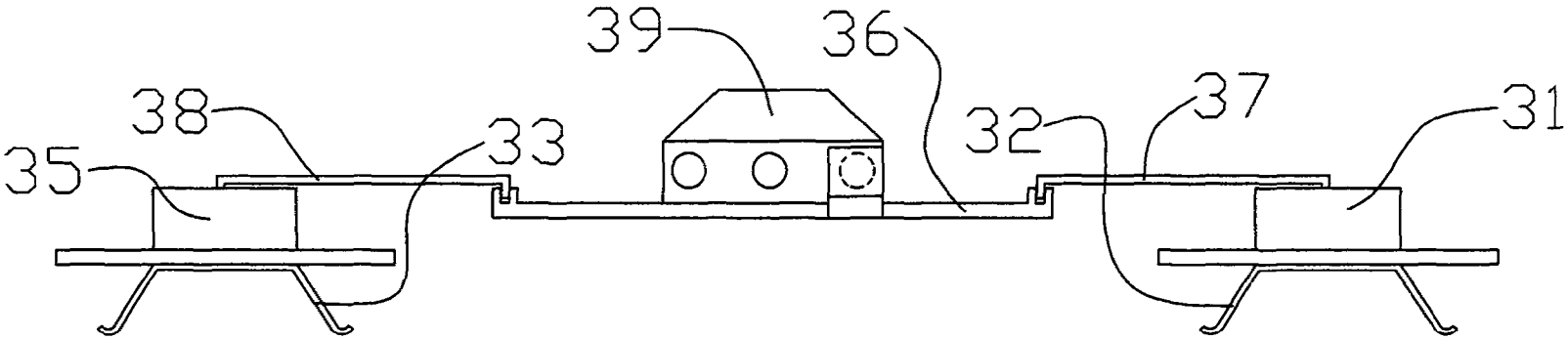
FIG. 9A Side view of switches; center-knob fitted with spring-loaded plunger to lock switches into selected position.

FIG. 9A: A side-view of the three sections of the Slideable-Linkage, shown aligned and engaged for simultaneous switching. Spring-loaded ball plunger 44, engages with detents in switch 39, to retain all switches in their posterior-most or anterior-most or central positions.

Figure 9B:
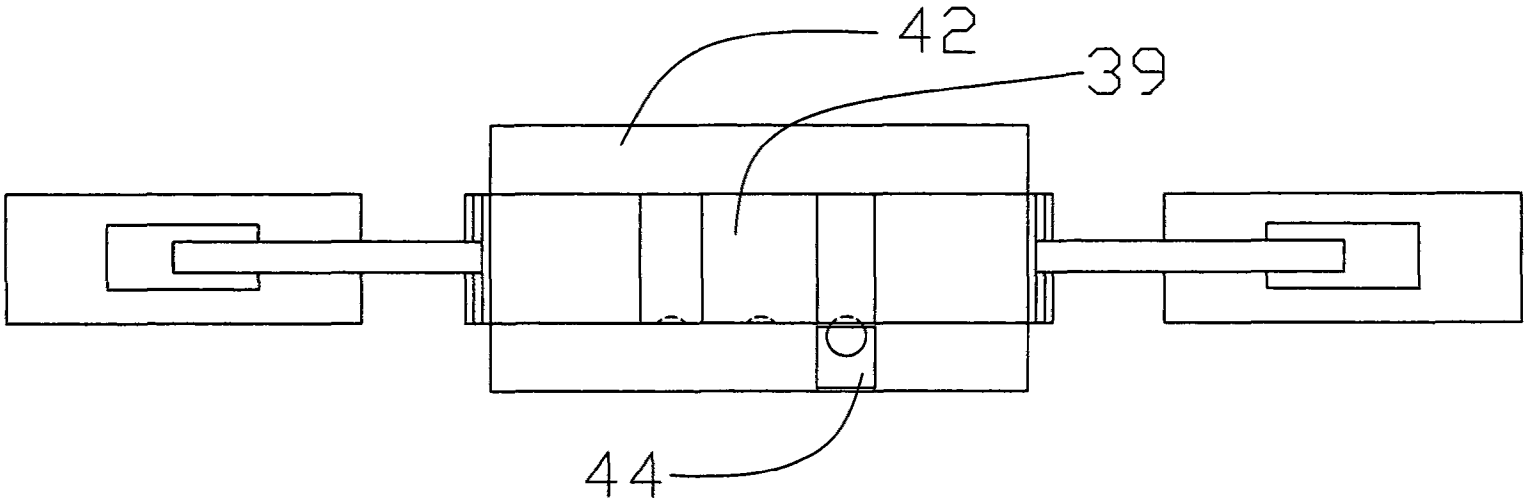

FIG. 9B: A top-view of the three sections of the Slideable-Linkage, shown aligned and engaged for simultaneous switching.

Figure 9C:
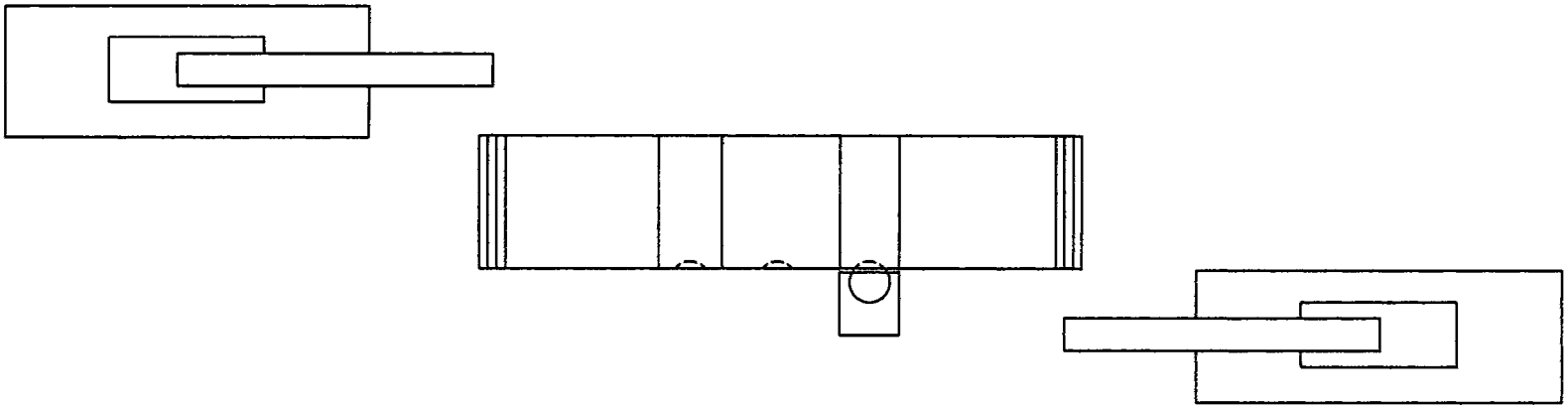

FIG. 9C: The three sections of the Slideable-Linkage are shown out-of-alignment, when rotation is being applied to handle while driving hardware.

FIG. 10: View of the internal configuration and rotation analysis of components with CW rotation applied to the input to produce CW rotation at the output.

Figure 11:
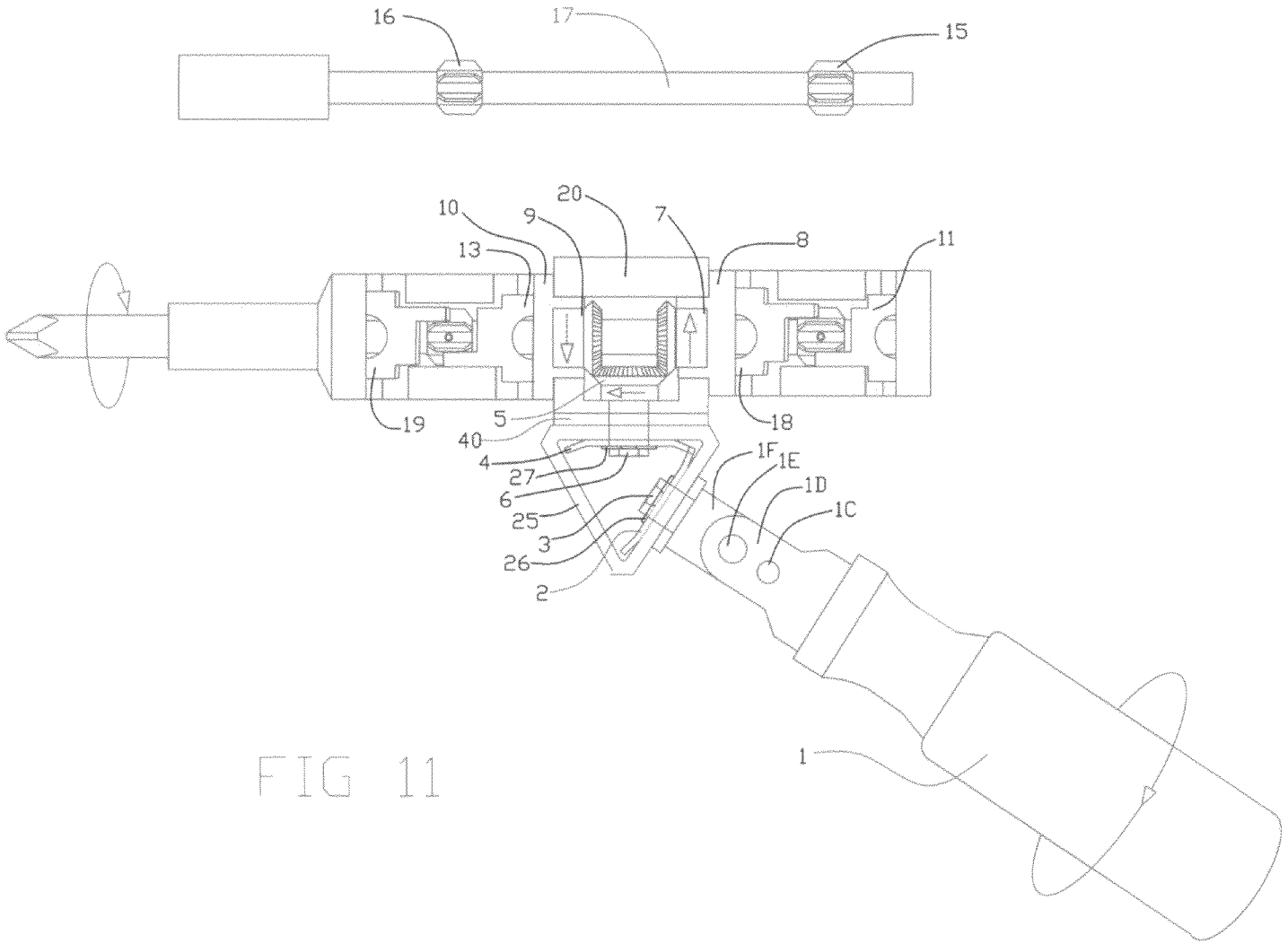
FIG. 11 View of rotational analysis of internal components. With switches in clockwise output mode, counterclockwise rotational input, produces clockwise rotational output.

FIG. 11: View of the internal configuration and rotation analysis of components with CCW rotation applied to the input to produce CW rotation at the output.

Figure 12:
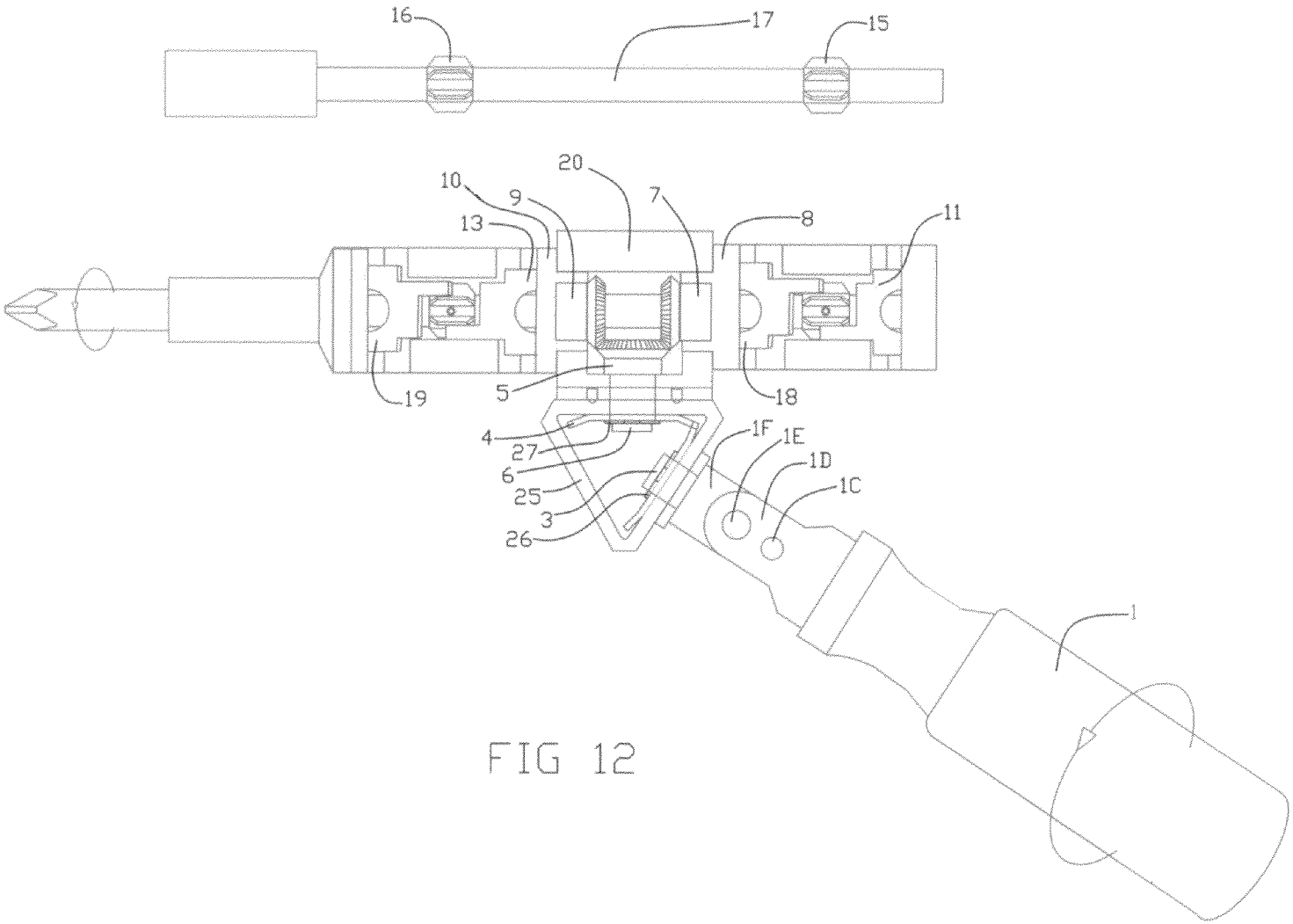
FIG. 12 View of rotational analysis of internal components. With switches in counterclockwise output mode, counterclockwise rotational input, produces counterclockwise rotational output.

FIG. 12: View of the internal configuration and rotation analysis of components with CCW rotation applied to the input to produce CCW rotation at the output.

Figure 13:
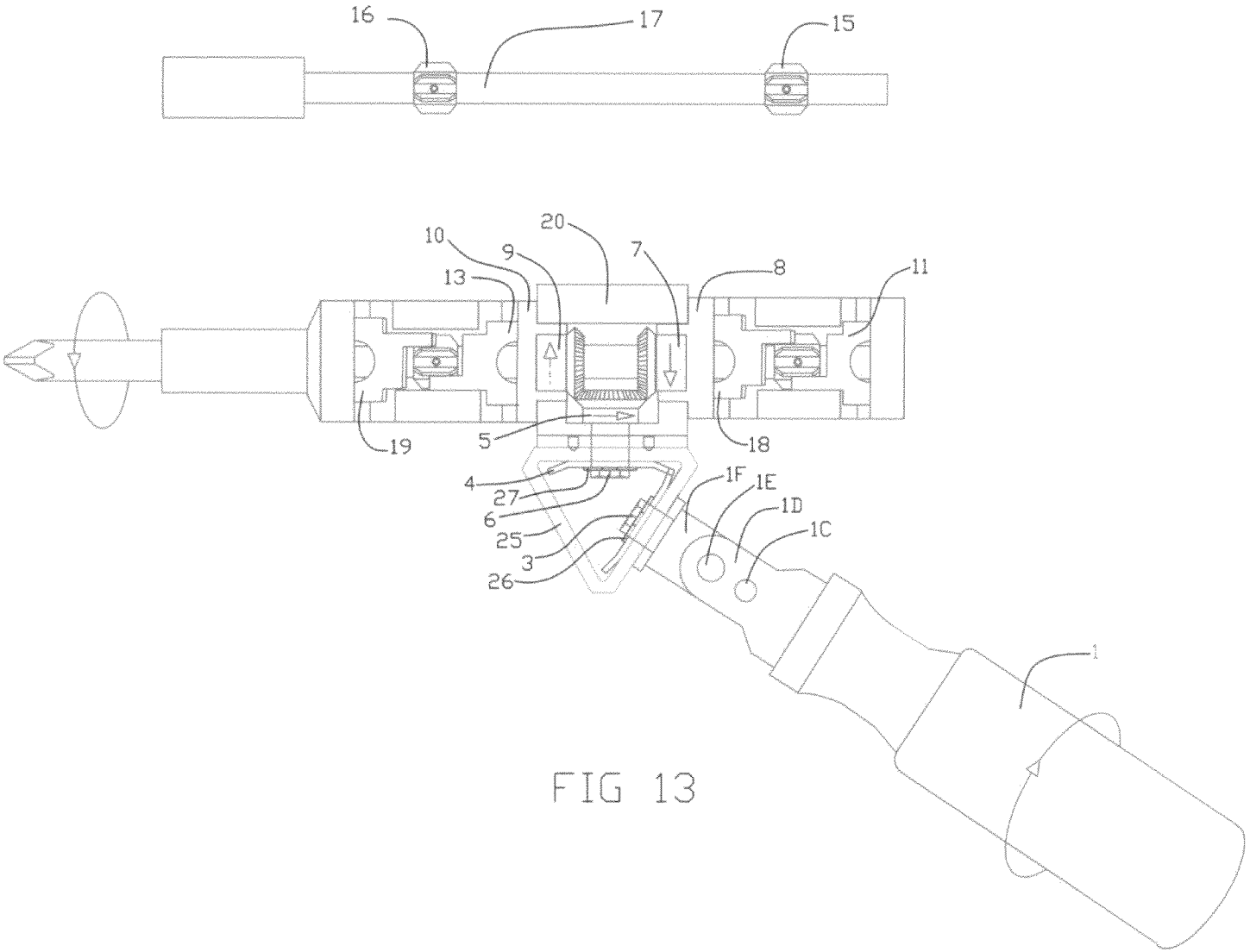
FIG. 13 View of rotational analysis of internal components. With switches in counterclockwise output mode, clockwise rotational input, produces counterclockwise rotational output.

FIG. 13: View of the internal configuration and rotation analysis of components, with CW rotation applied to the input to produce CCW rotation at the output.

Figure 14:
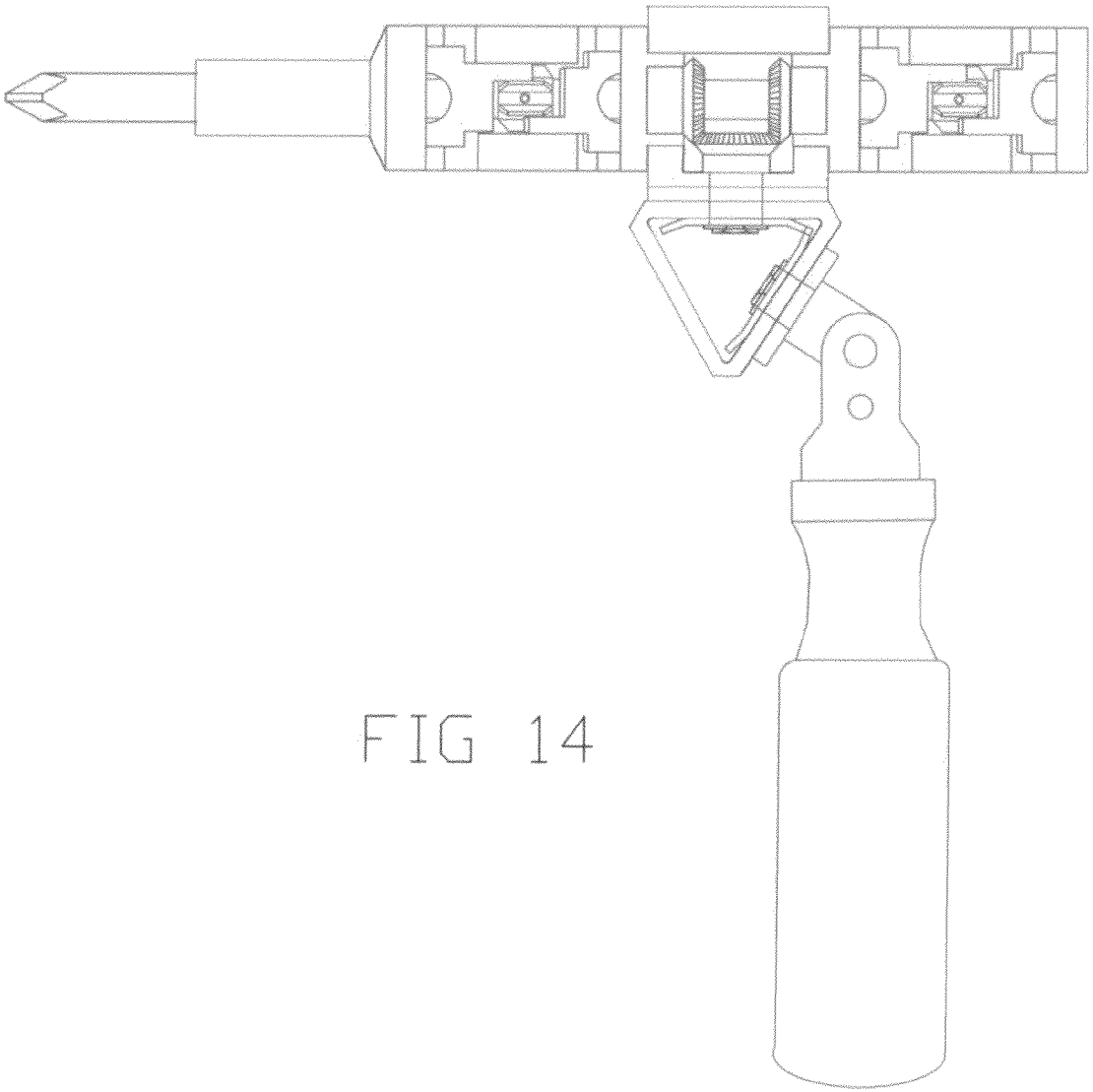
FIG. 14 Handle is angled down to perpendicular to body

FIG. 14: The adjustable handle is angled to 90-degrees from the driver body for increased torque capability.

Figure 15:
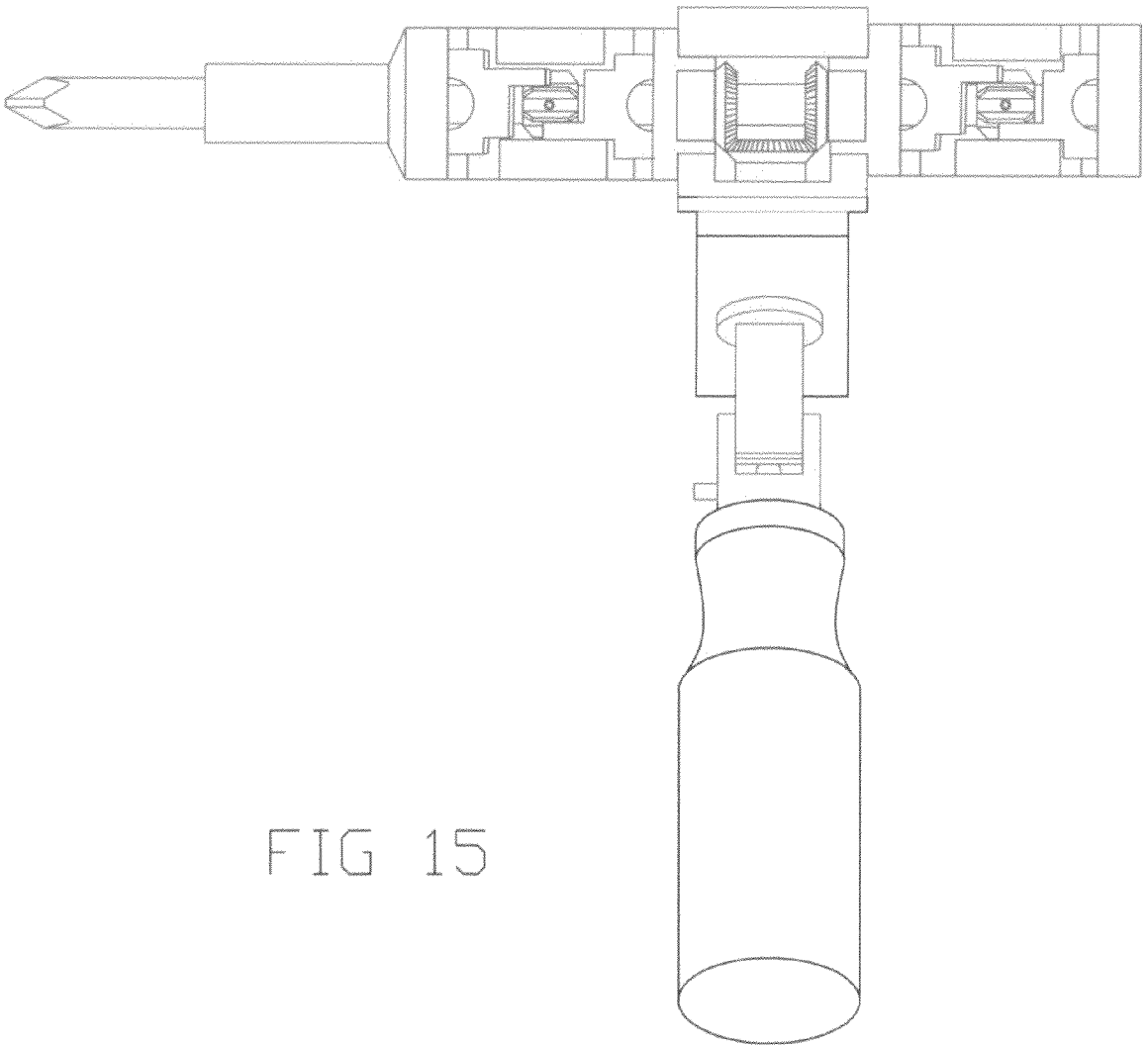
FIG. 15 Handle is pivoted to 90 degrees from original position.

FIG. 15: The handle pivots to 90-degrees to the driver body, for perpendicular driving.

Figure 16:
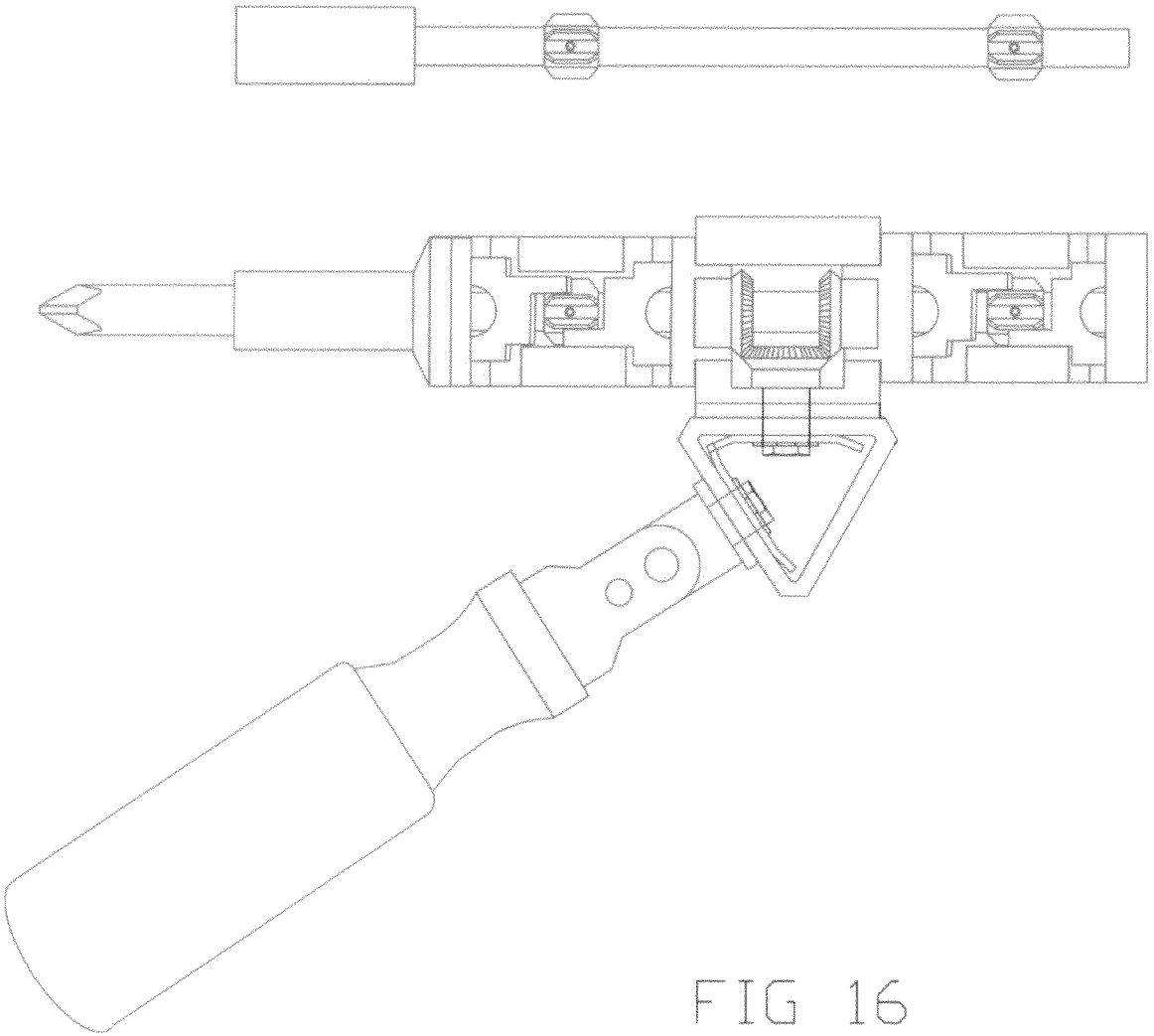
FIG. 16 Handle is pivoted 180-degrees from original position.

FIG. 16: The handle pivots to 180-degrees to the driver body, for special driving applications.

DESCRIPTION OF TH PREFERRED EMBODIMENT

The following describes the dynamic cooperation of components of a self-ratcheting mechanism that employs a pair of standard ratchet and pawl arrangement. FIG. 6: Switches 31, 33 and 39 are set into position, to cause CW output, whereby, posterior leg 30, of switch 31, forces finger of pawl 11 into engagement with tooth wheel 15, while its anterior leg 32, forces finger of pawl 18 to pivot out of engagement from tooth wheel 15. Posterior leg 33 of switch 35, forces finger of pawl 13 into engagement with tooth wheel 16, while its anterior leg 34, forces finger of pawl 19 to pivot out of engagement from tooth wheel 16. CW rotation applied to the input-handle, causes CW output-rotation at the driving end.

FIG. 10: clockwise rotation applied 'axially' to handle 1, causes Gear 2 to rotate CW, Gear 4 and axle 6 to rotate CW, Gear 5 to rotate CW, Gear 9 to rotate CW, ratchet Housing 10 to rotate CW, Finger of Pawl 13 to mesh with and impart CW rotation on Tooth Wheel 16, which imparts CW rotation on output Driveshaft 17. Simultaneously, Gear 5, while rotating CW, causes Gear 7 to rotate CCW, Ratchet Housing 8 to rotate CC and Finger of Pawl 11 to override Tooth Wheel 15, thereby ratcheting-up automatically.

FIG. 11: counterclockwise rotation applied 'axially', to handle 1, causes Gear 2 to rotate CCW, Gear 4 and axle 6 to rotate CCW, Gear 5 to rotate CCW, Gear 7 to rotate CW, Ratchet Housing 8 to rotate CW, Finger of Pawl 11 to impart CW rotation on Tooth Wheel 15, which imparts CW rotation on output Driveshaft 17. Simultaneously, Gear 5, rotating CCW, causes Gear 9 to rotate CCW, Ratchet Housing 10 to rotate CCW, Finger of Pawl 13 to override Tooth Wheel 16, thereby ratcheting-up automatically.

FIG. 7: Switches 31, 33 and 39, are set into position, to cause CCW output, whereby, anterior leg 32 of switch 31, forces finger of pawl 18 into engagement with tooth wheel 15, while its posterior leg 30, forces finger of pawl 11 to pivot out of engagement from tooth wheel 15. Anterior leg 34 of switch 35, forces finger of pawl 19 into engagement with tooth wheel 16, while its posterior leg 33, forces finger of pawl 13 to pivot out of engagement from tooth wheel 16. CW rotation applied to the input-handle, causes CW output-rotation at the driving end. CCW rotation is applied to the input-handle, to cause CCW output-rotation at the driving end.

FIG. 12: counterclockwise rotation applied 'axially' to handle 1, causes Gear 2 to rotate CCW, Gear 4 and axle 6 to rotate CCW, Gear 5 to rotate CCW, Gear 9 to rotate CCW, Ratchet Housing 10 to rotate CCW, Finger of Pawl 19 to impart CCW rotation on Tooth Wheel 16, which imparts CCW rotation on output Driveshaft 17. Simultaneously, Gear 5, rotating CCW, causes Gear 7 to rotate CW, Ratchet Housing 8 to rotate CW, Finger of Pawl 18, to override Tooth Wheel 15, thereby ratcheting-up automatically.

FIG. 13: clockwise rotation applied 'axially' to handle 1, causes Gear 2 to rotate CW, Gear 4 and axle 6 to rotate CW, Gear 5 to rotate CW, Gear 7 to rotate CCW, Ratchet Housing 8 to rotate CCW, Finger of Pawl 18 to impart CCW rotation on Tooth Wheel 15, which imparts CCW rotation on output Driveshaft 17, to rotate output CCW. Simultaneously, Gear 5, rotating CW, causes Gear 9 to rotate CW, Ratchet Housing 10 to rotate CW, Finger of Pawl 19 to override Tooth Wheel 16, thereby ratcheting-up automatically.

FIG. 8: Switches 31, 33 and 39 are set into position, to cause standard direct-drive (non-ratcheting), whereby, anterior leg 32 of switch 31, forces finger of pawl 18 into engagement with tooth wheel 15, while its posterior leg 30 forces finger of pawl 11 into engagement with tooth wheel 15. Anterior leg 34 of switch 35, forces finger of pawl 19 into engagement with tooth wheel 16, while its posterior leg 33, forces finger of pawl 13 into engagement with tooth wheel 16.

FIG. 9: The three sections of the Slideable-Linkage are shown out-of-alignment, when rotation is being applied to handle while driving hardware. Spring-loaded ball plunger 44, mates with detents in switch 39, to retain all switches in their posterior-most or anterior-most or central positions FIG. 9A: The three sections of the Slideable-Linkage are shown in-alignment for simultaneously moving all three switches to one of three positions.

FIG. 14: With both ratchets in locked position, Pistol-Grip Handle is pivoted down further, to perpendicular to screw-driver body, to provide increased mechanical advantage, for applying final fastening torque.

FIG. 15: Handle is pivoted perpendicular to screwdriver body, to enable driving hardware at a 90-degree angle for motion-limited spaces.

FIG. 16: Handle is shown pivoted 180-degrees and can be pivoted 360-degrees. While the description lists numerous specifics, it must be understood that these specifics are solely for the purpose of exemplification. The dual-drive self-ratcheting mechanism employs a minimum of a pair of any ratchet and pawl arrangement or clutching means to achieve the dual-drive self-ratcheting function. Numerous configurations, consisting of various other literal and/or equivalent mechanical components, can be employed, to achieve a device, that when locked into clockwise rotational output, converts oscillatory motion applied to its input, into only clockwise axial rotation at its output, and that when locked into counter-clockwise rotational output, converts oscillatory motion applied to its input, into only counter-clockwise axial rotation at its output, within the same embodiment.

What is claimed is:

1. A dual-drive ratcheting device, that, within the same embodiment, can be set to clockwise rotational output and converts oscillatory motion applied to an input, into solely clockwise rotational motion at an output; and can be set to counter-clockwise rotational output and converts oscillatory motion applied to said input, into solely counter-clockwise rotation motion at said output and comprising;

a driveshaft;

at least two driving elements spaced apart and coaxially mounted on said driveshaft with each driving element coupled to a means for engaging and disengaging said driveshaft, so that the driveshaft is always entrained in only one direction of axial rotation, when at least: one of the said driving elements is rotated in that direction, while the driveshaft is overrun by driving elements, that are rotated in the opposite direction;

a reversing element, coupling the driving elements together and causing said driving elements to always rotate in opposite directions, so that at least one of said driving elements entrains the driveshaft and the remaining, overrides the driveshaft, thus causing the driveshaft to always rotate axially, in only one direction, regardless of the direction of rotation of the driving elements;

an adjustable-angle input handle, having a pistol type grip and a non-coaxial disposition with the driveshaft for optimum user comfort and efficiency and rotates axially clockwise and counterclockwise and swings radially for increased torque, wherein said adjustable-angle input-handle is coupled to said reversing element, which is accessible through an opening in the wall of a reversing mechanism housing, to simultaneously prevent the axial rotation of said reversing mechanism housing, while enabling the turning of the input handle axially repeatedly and alternatingly clockwise and counterclockwise, thereby activating the dual-drive action single-handedly, with said handle axially turning said reversing element alternatingly in clockwise and counterclockwise directions, while reversing element meshes with and causes the first and second driving miter gears to coaxially rotate oppositely, to cause the engaging means to alternatingly engage and disengage, to entrain the driveshaft, into a single selected direction-of-rotation at the output and enable a user's opposite hand to hold a workpiece; and a pivoting means, for the handle to be positioned radially as required.

2. The dual-drive ratcheting device of claim 1 wherein;

the drive shaft includes a socket at one of its ends for receiving and driving tool bits;

wherein said driving elements and said reversing element are mitre gears, and said means for engaging and disengaging said drive shaft has the capability of selectively engaging the drive shaft, for imparting axial rotation in either direction, operable in forward, reverse, and standard modes and disengaging, for overriding the drive shaft, from an oscillatory input motion;

said reversing element is fixed on an axle and disposed perpendicularly to said driving elements for meshing simultaneously with said driving elements facing each other causing opposite rotation about the drive shaft in either direction;

said reversing mechanism housing of claim 1, encloses said miter;

the driving elements are arranged in tandem on the said drive shaft;

an anti-rotation nest is provided, with a central channel coupling to said housing and preventing rotation of said housing;

a triangular bracket is provided with an opening centered in two adjacent legs, one side of said bracket being pivotally-retained to said axle and parallel to said housing, and a second side for mounting to said handle; and said pivoting means is coupled to one end of said handle for pivoting and locking said handle into a plurality of predetermined angles, with the face of said handle rotatably retained against the outside surface of the corresponding one of said two adjacent legs for bidirectional axial rotation and radial swing of said handle.

3. The dual-drive ratcheting device of claim 1, wherein said handle further comprises a triangular bracket in between said handle and said reversing element.

4. The dual-drive ratcheting device of claim 3, wherein said handle further comprises an pivot in between the bracket and a first portion of said handle with a second portion being rotational.

5. The dual-drive ratcheting device of claim 2, wherein said means for engaging and disengaging comprises two-way roller type clutches.

6. The dual-drive ratcheting device of claim 2, wherein said means for engaging and disengaging comprises one-way roller type clutches.

7. The dual-drive ratcheting device of claim 2 wherein said means for engaging and disengaging comprises ratchet wheels and pawls.

* * * * *